US005736312A

United States Patent [19]

Jagannathan et al.

[11] Patent Number: 5,736,312

[45] Date of Patent: Apr. 7, 1998

[54] PROCESS FOR THE PREPARATION OF SILVER HALIDE EMULSIONS HAVING IODIDE CONTAINING GRAINS

[75] Inventors: Seshadri Jagannathan; Harold G. Judd, both of Rochester; Samuel Chen, Penfield; David E. Fenton, Fairport; Allen K. Tsaur; Kenneth J. Reed, both of Rochester, all of N.Y.

[73] Assignee: Eastman Kodak Company, Rochester, N.Y.

[21] Appl. No.: 753,073

[22] Filed: Nov. 20, 1996

[51] Int. Cl.[6] ..... G03C 1/035; G03C 1/015

[52] U.S. Cl. ..... 430/569; 430/567

[58] Field of Search ..... 430/567, 569

[56] References Cited

U.S. PATENT DOCUMENTS 5,389,508 2/1995 Takada et al. ..... 430/367
5,476,760 12/1995 Fenton et al. ..... 430/567

FOREIGN PATENT DOCUMENTS 0 561 415 9/1993 European Pat. Off. ..... G03C 1/005

*Primary Examiner*—Mark F. Huff
*Attorney, Agent, or Firm*—Carl O. Thomas

[57] ABSTRACT

A process of preparing a photographic emulsion having radiation-sensitive silver iodohalide grains. Iodide is introduced into the grains by releasing iodide ions from iodate ($IO_3^-$). Release of iodide ions from the $IO_3^-$ is employed to enhance the uniformity of iodide availability during emulsion preparation, either during grain precipitation or subsequent halide conversion. The process of the invention is in one preferred form directed to the partial halide conversion of tabular grains. A speed-granularity advantage is demonstrated.

14 Claims, No Drawings

PROCESS FOR THE PREPARATION OF SILVER HALIDE EMULSIONS HAVING IODIDE CONTAINING GRAINS

FIELD OF THE INVENTION

The invention relates to a process of preparing iodide containing radiation-sensitive silver halide emulsions useful in photography.

DEFINITION OF TERMS

In referring to grains and emulsions containing two or more halides, the halides are named in order of ascending concentrations.

The term "silver iodohalide" in referring to grains or emulsions indicates a grain structure in which silver chloride and/or bromide provide a face centered cubic rock salt crystal lattice structure containing iodide ions.

The term "high bromide" in referring to grains and emulsions indicates that bromide is present in a concentration of greater than 50 mole percent, based on total silver.

The term "low surface iodide" in referring to grains indicates that iodide is present in a concentration of less than 2 mole percent, based on silver within 0.02 μm of the surface of the grains.

The term "halide converted" is employed in the art recognized sense to designate a silver halide grain structure in which halide ion that forms a less soluble silver halide has displaced from the crystal lattice structure of the grain halide ion that forms a more soluble silver halide.

The term "equivalent circular diameter" or "ECD" is employed to indicate the diameter of a circle having the same projected area as a silver halide grain.

The term "coefficient of variation" or "COV" is defined as 100 times the standard deviation of grain ECD divided by average grain ECD.

The term "monodisperse" in referring to the grain population of a silver halide emulsion indicates a COV of less than 30 percent.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

All potentials are referenced to a standard hydrogen electrode, which is by definition zero volts, unless otherwise stated.

*Research Disclosure* is published by Kenneth Mason Publications, Ltd., Dudley House, 12 North St., Emsworth, Hampshire P010 7DQ, England.

BACKGROUND

In the most widely employed form of photography, images are captured by a photographic element comprised of a support and at least one emulsion layer comprised of radiation-sensitive silver halide grains. The radiation-sensitive grains are prepared by reacting halide ions with silver ions in a dispersing medium. Silver chloride, silver bromide and silver iodide are known to be useful alone or in combination to form the radiation-sensitive grains.

Silver iodide grains exhibit β or γ phase crystal lattice structures that can accommodate only minor amounts of silver bromide and/or chloride. Difficulties with development have severely limited the use of these grains for latent image capture in photography.

Silver chloride and silver bromide each form a face centered cubic rock salt crystal lattice structure. All relative proportions of chloride and bromide ions can be accommodated in this crystal lattice structure. Iodide ion can be accommodated up to its saturation limit, which is approximately 40 mole percent, based on total silver, in a silver bromide crystal lattice structure and up to about 13 mole percent, based on silver in a silver chloride crystal lattice structure, the exact limit being varying within a few percent, based on temperature.

A large proportion of photographic emulsions contain silver iodohalide grains—that is, grains in which a significant, performance modifying concentration of iodide is contained in a face centered cubic rock salt crystal lattice structure formed by one or both of the silver chloride and bromide. The highest levels of photographic sensitivity are typically realized by providing high bromide grains containing a minor amount of iodide, such as silver iodobromide grains. The presence of minor amounts of iodide ion can also enhance the sensitivity of high chloride grains.

To appreciate the techniques and difficulties for preparing mixed halide grains that contain iodide, it is necessary to appreciate the relative solubilities of the different photographically useful silver halides.

Although the majority of the silver and halide ions are confined to the grains, at equilibrium a small fraction of the silver and halide ions are also present in the dispersing medium, as illustrated by the following relationship:

$$Ag^+ + X^- \leftrightharpoons AgX \quad \text{(I)}$$

where X represents halide. From relationship (I) it is apparent that most of the silver and halide ions at equilibrium are in an insoluble form while the concentration of soluble silver ions ($Ag^+$) and halide ions ($X^-$) is limited. However, it is important to note that equilibrium is a dynamic relationship—that is, a specific halide ion is not fixed in either the right hand or left hand position in relationship (I). Rather a constant interchange of halide ion between the left and right hand positions is occurring.

At any given temperature the activity product of $Ag^+$ and $X^-$ is at equilibrium a constant and satisfies the relationship:

$$Ksp = [Ag^+][X^-] \quad \text{(II)}$$

where Ksp is the solubility product constant of the silver halide. To avoid working with small fractions the following relationship is also widely employed:

$$-\log Ksp = pAg + pX$$

where pAg represents the negative logarithm of the equilibrium silver ion activity and pX represents the negative logarithm of the equilibrium halide ion activity.

From relationship (III) it is apparent that the larger the value of the −log Ksp for a given halide, the lower is its solubility. The relative solubilities of the photographic halides (Cl, Br and I) can be appreciated by reference to Table I:

TABLE I

| Temp. °C. | AgCl −log Ksp | AgBr −log Ksp | AgI −log Ksp |
|---|---|---|---|
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

From Table I it is apparent that at 40° C. the solubility of AgCl is one million times higher than that of AgI, while the solubility of AgBr ranges from about one thousand to ten thousand times that of AgI.

When silver ion and two or more halide ions are concurrently introduced into a dispersing medium, the silver ion precipitates disproportionately with the halide ion that forms the least soluble silver halide. It is therefore appreciated that the presence of local iodide ion concentration variances in the dispersing medium in the course of precipitation of silver iodohalide grains result in iodide ion non-uniformities in the grains precipitated. When the limited ability of a face centered cubic rock salt crystal lattice structure to accommodate iodide ions is taken into account, it is readily appreciated that if iodide ion non-uniformities in the dispersing medium are sufficiently large, a separate, unwanted high iodide (β or γ phase) grain population can be produced.

As a technique for better controlling the uniformity of iodide ion availability within the dispersing medium it has been recently suggested (see Takada et al U.S. Pat. No. 5,389,508 and Kikuchi et al EPO 0 561 415) that the uniformity of iodide ion within the dispersing medium can be better controlled by introducing iodide in the form of a compound satisfying the formula:

$$R—I \qquad (IV)$$

wherein R represents a monovalent organic residue which releases iodide on upon reacting with a base or a nucleophilic reagent, such as sulfite, acting as an iodide ion releasing agent.

It is known that the properties of silver halide grains can be modified by halide conversion. This is accomplished by introducing into a silver halide emulsion halide ions that have a lower solubility than halide ions contained in the grains while withholding the introduction of silver ions. For example, silver chloride grains can be transformed into converted halide grains by the introduction of bromide and/or iodide ions. Similarly, silver bromide grains can be transformed into converted halide grains by the introduction of iodide ions.

As a less soluble halide ion replaces a more soluble halide ion in the crystal lattice of the silver halide grain, a disruption of the crystal lattice occurs, since the reduction in silver halide solubility in progressing from chloride to bromide to iodide ions is also accompanied by an increase in the physical size of the ions. Halide conversion is known to create crystal lattice dislocations.

An early use of converted halide emulsions was to create silver halide grains that would, by reason of the internal crystal lattice disruptions, form latent image sites predominantly within the interior of the grains. Thus their use was primarily as direct positive emulsions, but they have also been used to advantage as negative working emulsions.

When interest developed in tabular grain emulsions in the early 1980's, halide conversions of tabular grains of the type previously practiced on conventional nontabular grains were observed to degrade or destroy the tabular character of the grains. Limited halide conversions of tabular grains were recognized to be possible, but in practice even limited halide conversions of tabular grain emulsions were avoided.

Recently Fenton et al U.S. Pat. No. 5,476,700 demonstrated that low surface iodide high bromide host tabular grain emulsions that undergo a limited halide conversion with potassium iodide followed by subsequent silver halide deposition are capable of producing higher photographic speeds than when the double-jet addition of silver and iodide ions replaces the halide conversion step. This has provided the art with its first positive incentive to incorporate a halide conversion step into the preparation of high bromide tabular grain emulsions.

In attempting to practice partial halide conversions on low surface iodide high bromide tabular grains it has been observed that a significant portion of the tabular grains are damaged in the halide conversion step. Specifically, significant concentrations of small grains are observed after halide conversion that have iodide concentrations matching the peak iodide concentrations introduced into the surviving tabular grains by halide conversion. It is believed that these small grains are fragments of tabular grains that "exploded" during the halide conversion step. That is, excessive stresses placed on the crystal lattice structure, believed to be attributable to excessive local iodide concentrations, have resulted in the tabular grain disintegrating. These fragments of tabular grains are hereinafter referred to as exploded grains or EG's.

In addition to the exploded grains a significant population of tabular grains have been observed that are only partially intact. These grains often appear to have had a bite taken out of the grain at an edge or a corner. From microscopic examination it has been concluded that these grains have impinged on a local area with an excessively high iodide ion concentration during the halide conversion step. If the tabular grain had been somewhat more centrally located in the local high iodide ion concentration region responsible for grain degradation, the grain would have exploded. These tabular grains are hereafter referred to as partially intact grains or PIG's.

The incidence of exploded grains and partially intact grains correlates inversely with the efficiency of the halide conversion process in producing partially halide converted low surface iodide high bromide tabular grains capable of providing increased photographic speed. Thus, the inclusion of exploded grains and partially intact grains in partially halide converted high bromide tabular grain emulsions works against achieving the highest attainable levels of photographic performance.

RELATED PATENT APPLICATION

Jagannathan et al U.S. Ser. No. 08/657,827, filed May 31, 1996, commonly assigned, titled TABULAR GRAIN EMULSIONS WITH SELECTED SITE HALIDE CONVERSIONS AND PROCESSES FOR THEIR PREPARATION, discloses a halide conversion process comprised of providing a radiation-sensitive emulsion containing a gelatino-vehicle and silver halide grains and introducing iodide ions into the grains, wherein the radiation-sensitive emulsion as provided includes tabular grains which (a) are comprised at least 90 mole percent bromide and up to 10 mole percent iodide, based on silver, and (b) have {111} major faces that (i) form corners joined by linear edges and (ii) account for at least 70 percent of total grain projected area, the pBr of the emulsion provided is maintained at less than 3.5, an iodide ion source exhibiting a second order reaction rate constant with the gelatino-vehicle of less than $10^{-3}$ mole$^{-1}$ sec$^{-1}$ is introduced into the emulsion and reacted with the gelatino-vehicle to release iodide ions, and the released iodide ions selectively displace halide ions to create dislocations confined to defined corner regions of the tabular grains.

SUMMARY OF THE INVENTION

In one general form this invention provides a novel process for increasing the uniformity of iodide ion introduced into radiation-sensitive silver iodohalide grains.

In one aspect this invention is directed to a process for preparing a photographically useful emulsion comprised of a dispersing medium and radiation-sensitive silver iodohalide grains comprised of the following steps: (1) providing an aqueous dispersing medium including a peptizer for the silver iodohalide grains, (2) precipitating silver halide grains having a face centered cubic rock salt crystal lattice structure, and (3) introducing into the crystal lattice structure iodide ions released from $IO_3^-$.

In a preferred application this invention provides a novel process for achieving the partial halide conversion of monodisperse low surface iodide high bromide tabular grains that allows a higher proportion of partially halide converted silver iodohalide grains to be obtained without observable structural damage.

In one preferred form this invention is directed to a process of preparing a high bromide tabular grain emulsion comprised of tabular grains containing within a portion thereof iodide ions introduced by displacement of halide ions comprising (1) providing a monodisperse high bromide host tabular grain emulsion accounting for from 60 to 90 percent of total silver present at the completion of step (3), (2) introducing iodide ion in an aqueous solution into the host tabular grain emulsion while withholding addition of silver ion, the iodide ion amounting to from 0.5 to 10 mole percent, based on silver present in the host emulsion, and (3) thereafter continuing growth of the host tabular grains modified by iodide ion introduction until silver added in this step accounts for from 10 to 40 of total silver, wherein (4) in step (1) grains present in the host tabular grain emulsion exhibit a surface iodide concentration of less than 2 mole percent, based on silver within 0.02 μm of the surface of the grains, and (5) during step (2) the iodide ion is released from $IO_3^-$.

It has been discovered that by introducing iodate ($IO_3^-$) and then releasing iodide ion ($I^-$) from the iodate a better control over iodide ion uniformity the emulsion dispersing medium is realized. As shown in the Examples below, this translates into a higher proportion of grains of the characteristics sought. The controlled rate of iodide ion release from iodate can result in emulsion preparation processes that are more robust (that is, less susceptible to emulsion variation as a function of inadvertent variances encountered during manufacture) and more easily adjusted in shifting from one scale of manufacture to another.

It has been discovered additionally that silver iodohalide emulsions prepared by introducing iodide ion released from iodate provide improved speed-granularity relationships as compared to emulsions in which iodide ion is released from an organic iodide compound, such as defined above.

It has been observed further that partially halide converted tabular grain emulsions prepared starting with monodisperse high bromide host tabular grain emulsions having iodide released from iodide introduced during halide conversion by interaction with sulfite ($SO_3^{=}$) exhibit unexpectedly high levels of photographic sensitivity as well as superior speed-granularity relationships.

DESCRIPTION OF PREFERRED EMBODIMENTS

This invention is generally applicable to any conventional process for preparing a photographically useful emulsion comprised of a dispersing medium and radiation-sensitive silver iodohalide grains comprised of the following steps:

(1) providing an aqueous dispersing medium including a peptizer for the silver iodohalide grains, (2) precipitating silver halide grains having a face centered cubic rock salt crystal lattice structure.

During or subsequent to step (2) iodide ions are introduced into the crystal lattice structure by reaction of iodate ($IO_3^-$) with a mild reducing agent—that is, a reducing agent that is strong enough to prevent the generation of $I_2$, but incapable of reducing fogging the grains (reducing $Ag^+$ to $Ag^o$).

In a widely employed approach for preparing photographic emulsions containing radiation-sensitive silver iodohalide grains compatible with the processes of the invention an aqueous dispersing medium containing a peptizer is placed into a reaction vessel. The peptizer is typically a gelatino-peptizer, but a variety of hydrophilic colloids are known to be useful as peptizers, as illustrated by *Research Disclosure*, Vol. 389, September 1996, Item 38957, II. Vehicles, vehicle extenders, vehicle-like addenda and vehicle related addenda, A. Gelatin and hydrophilic colloid peptizers. The aqueous medium initially added typically accounts for at least 10 percent of the total dispersing medium present at the conclusion of emulsion precipitation. Preferably from 20 to 80 percent of the total dispersing medium is initially present in the reaction vessel. The volume of the dispersing medium introduced initially into the reaction vessel can equal the volume of the dispersing medium at the conclusion of precipitation where removal of water and soluble salts takes place during precipitation. For example, ultrafiltration during precipitation is disclosed by Mignot U.S. Pat. No. 4,334,012. The peptizer typically forms from 0.2 to 10 (preferably 6) percent by weight of the contents of the reaction vessel. It is usually convenient to place at least a portion of the peptizer in the reaction vessel prior to precipitation, but it is appreciated that silver halide grains at and shortly following grain nucleation can be maintained in a dispersed state in the absence of peptizer. Thus, delayed addition of peptizer is contemplated. Finally, at least a small amount of a soluble chloride or bromide salt, such as an alkali, alkaline earth or ammonium halide salt, is introduced into the dispersing medium to assure a stoichiometric excess of halide ion with respect to silver ion at the initiation of precipitation.

Subsequently a soluble silver salt, such as silver nitrate, is introduced through a first jet. A soluble iodide salt, such as an alkali, alkaline earth or ammonium iodide salt, is introduced through a second jet. Chloride and/or bromide ions can be introduced through the second jet with the iodide or introduced through one or more separate jets. If sufficient chloride and/or bromide salt is initially placed in the reaction vessel, it is possible to dispense with further chloride and/or bromide addition. In most instances chloride and/or bromide ions are introduced into the reaction vessel concurrently with the introduction of silver ion.

The addition of iodide to the reaction vessel is limited in relation of the chloride and/or bromide present in the reaction vessel so that silver iodohalide grains are precipitated exhibiting a face centered cubic rock salt crystal lattice structure. This is achieved by limiting iodide addition to less than the saturation level of iodide ion in the silver chloride and/or bromide crystal lattice being formed by precipitation.

While iodide ion constitutes only a minor component of the silver iodohalide grains, its concentration and distribution can significantly influence photographic performance. Detectable modifications of photographic performance, such as imaging speed, can be realized with iodide levels as low as 0.05 (preferably 0.1) mole percent, based on total silver forming the radiation-sensitive grains. While iodide concentrations can range up to saturation levels in the face centered cubic rock salt crystal lattice structure, for most photographic applications iodide levels are limited to less than 10 (preferably 5) mole percent, based on total silver.

Both uniform and non-uniform iodide distributions are common, as illustrated by *Research Disclosure*, Item 38957, cited above, I. Emulsion grains and their preparation, A. Grain halide composition, paragraph (4). Typically low surface iodide concentrations are desired, although Chaffee et al U.S. Pat. No. 5,358,840 illustrates advantageous photographic properties with a maximum iodide concentration at the surface of the grains.

The silver iodohalide grains produced by the process of the invention can take any conventional shape. Illustrations of varied forms of silver iodohalide grains are provided by *Research Disclosure*, Item 38957, cited above, I. Emulsion grains and their preparation, B. Grain morphology.

In a preferred application the process of the invention is employed to prepare iodide containing high bromide tabular grain emulsions. Illustrations of conventional processes of preparing iodide containing high bromide tabular grain emulsions are provided by the following, the disclosures of which are here incorporated by reference:

Wilgus et al U.S. Pat. No. 4,434,226;
Kofron et al U.S. Pat. No. 4,439,520;
Daubendiek et al U.S. Pat. No. 4,414,310;
Black et al U.S. Pat. No. 5,334,495;
Solberg et al U.S. Pat. No. 4,433,048;
Yamada et al U.S. Pat. No. 4,647,528;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Chaffee et al U.S. Pat. No. 5,358,840; and
Delton U.S. Pat. No. 5,372,927.

The process of the present invention can be practiced by modifying conventional silver iodohalide emulsion precipitations of the type described above by substituting a soluble iodate ($IO_3^-$) for the soluble iodide salt conventionally introduced in aqueous solution during grain precipitation. The iodate counter ion is selected (a) to permit iodate solubility in the dispersing medium and (b) to avoid unwanted interaction with the silver iodohalide grains being precipitated. The same alkali, alkaline earth and ammonium counter ions conventionally present in iodide salts are specifically contemplated for use in the process of the invention.

When the iodate is delivered to the dispersing medium within the reaction vessel, it does not immediately release iodide ion for incorporation within the grains. This offers the advantage of avoiding excessive local iodide concentrations. In conventional silver iodohalide grain precipitations grains that happen to impinge upon the point of iodide ion introduction encounter higher iodide ion concentrations than the remainder of the grains, resulting in grain-to-grain variances in iodide levels and, often, variations in the structural form and photographic performance of the grains. By delaying iodide ion release until the iodate has been introduced and thoroughly distributed within the dispersing medium, local grain-to-grain and unintended intragrain variances in iodide content are entirely avoided.

Release of iodide ion from the iodate into the dispersing medium is achieved in a redox reaction of the iodate with a reducing agent. The reducing agent can be chosen from among a variety of intermediate strength reducing agents. The oxidation strength of the reducing agent must be sufficiently electropositive to not only to reduce the iodate, but also to assure that iodide ions ($I^-$) are generated rather than molecular iodine ($I_2$). The latter dictates that the reducing agent have an oxidation potential less positive than +0.620 volts. At the same time, if the reducing agent is too vigorous, there is a risk of fogging the emulsion—that is, directly reducing $Ag^+$ to $Ag^o$. AgBr is reduced to $Ag^o$ at a potential of +0.095 volt. Thus, the reducing agents are chosen to have an oxidation potential more positive than this amount.

A variety of conventional silver halide developing agents have oxidation potentials within the range of from less positive than +0.620 V and to more positive than +0.095 volt. For example, alkyl and alkoxy substituted hydroquinones having oxidation potentials ($E_o$) in this range are reported in James *The Theory of the Photographic Process*, 4th Ed., Macmillan, New York, 1977, p. 305, Table 11.2. From Table 11.3 (p. 306) of James the oxidation potential of ascorbic acid, a two electron reducing agent known to be useful as a developing agent, can be calculated from equation 11.31 (p. 304) to be about 0.596 volt.

The suitability of reducing agents that for reducing iodate to iodide for which published oxidation can not be readily located can be determined by the following procedure:

(1) Dissolve 10 grams of the reducing agent to be tested in 90 gram of deionized water.

(2) Dissolve 10 grams of potassium iodate in 90 grams of deionized water.

(3) Mix the solutions of (1) and (2) at 40° C. and adjust to the pH of the dispersing medium in which use is contemplated and let stand for 3 hours.

(4) The presence of a yellow precipitate indicates that the reducing agent has undergone to the desired redox reaction with the iodate to release iodide ions. The yellow precipitate is silver iodide.

Specifically preferred reducing agents are sulfite ($SO_3^{=}$) salts. The oxidation potential of sulfite is 0.17 volt. As in the case of iodate, the counter ion of the sulfite is selected (a) to permit sulfite solubility in the dispersing medium and (b) to avoid unwanted interaction with the silver iodohalide grains being precipitated. The same alkali, alkaline earth and ammonium counter ions typically used with halide ions are specifically contemplated for use in the process of the invention. The sulfite and iodate ions can be associated with the same counter ions. It has been discovered that the sulfite not only releases iodide ion for incorporation into the grains, but it also contributes to achieving unexpectedly high levels of photographic sensitivity.

To insure that the iodate is efficiently utilized in the process of the invention, it is preferred to provide sufficient reducing agent to at least stoichiometrically satisfy the requirements for iodate reduction. At least a 1:1 molar ratio of the reducing agent to iodate is preferred. It is preferred to employ a stoichiometric excess of reducing agent in relation to iodate, up to a molar ratio 5:1 or even 10:1. As demonstrated in the Examples, the iodate can be introduced first into the dispersing medium of the emulsion followed by reducing agent addition or the order of addition can be reversed. Concurrent introduction of iodate and reducing agent is also contemplated.

A partial explanation of the advantage of substituting iodate and reducing agent for a compound that instantaneously releases iodide ion is in terms of the low value of the second order rate constant of the iodate and reducing agent redox reaction. The second order rate constant is in all instances less than $10^3$ $mole^{-1}sec^{-1}$ and, preferably less than $10^{-2}$ $mole^{-1}sec^{-1}$. The second order rate constant is derived from the following relationship:

$$dI^-/dt=k[IO_3^-][RA] \quad (V)$$

where k is the second order reaction rate constant;

dI/dt is the rate of iodide ion release, expressed in gram-atoms/second;

$[IO_3^-]$ is the molar concentration in moles per liter of iodate; and

[RA] is the molar concentration in moles per liter of the reducing agent.

At 60° C. the second order rate constant of the redox reaction of iodate and sulfite is $6\times10^{-3}$ $mole^{-1}sec^{-1}$.

Although the invention has been described in terms of substituting an iodate and a reducing agent for a water soluble iodide salt in preparing a silver iodohalide emulsion, it is appreciated that the iodate and reducing agent can be alternatively substituted for an organic iodide compound employed in combination with a base or nucleophilic reagent in processes of the type disclosed by Takada et al, here incorporated by reference, and Kikuchi et al, both cited above. Performance advantages for this substitution are demonstrated in the Examples below.

Instead of introducing iodide into the grains as they are being formed, it is recognized that iodide can be used to form silver iodohalide grains by halide conversion. During halide conversion the iodate and reducing agent are reacted to release iodide ion in a dispersing medium containing silver halide grains having a face centered cubic rock salt crystal lattice structure while withholding the addition of silver. Thus, the process of the invention can be readily adapted to any conventional halide conversion process. Conventional techniques for halide conversion are illustrated by *Research Disclosure*, Item 38957, cited above, I. Emulsion grains and their preparation, A. Grain halide composition, paragraph (8). Halide conversion using iodate according to the teachings of this invention is specifically preferred to be practiced on tabular grains that exhibit low surface iodide concentrations.

It is contemplated to undertake the partial halide conversion of low surface iodide high bromide tabular grain emulsions by the use of iodate as a source of iodide ion as described above. In a specifically preferred application, this invention is directed to a process of preparing a high bromide tabular grain emulsion comprised of tabular grains containing within a portion thereof iodide ions introduced by displacement of halide ions comprising (1) providing a monodisperse high bromide host tabular grain emulsion accounting for from 60 to 90 percent of total silver present at the completion of step (3), (2) introducing iodide ion in an aqueous solution into the host tabular grain emulsion while withholding addition of silver ion, the iodide ion amounting to from 0.5 to 10 mole percent, based on silver present in the host emulsion, and (3) thereafter continuing growth of the host tabular grains modified by iodide ion introduction until silver added in this step accounts for from 10 to 40 of total silver, wherein (4) in step (1) grains present in the host tabular grain emulsion exhibit a surface iodide concentration of less than 2 mole percent, based on silver within 0.02 μm of the surface of the grains, and (5) during step (2) the iodide ion is supplied by reaction of $IO_3^-$ with a reducing agent incapable of reducing $Ag^+$ to $Ag^o$.

Monodisperse low surface iodide high bromide host tabular grain emulsions can be selected from among the conventional high bromide tabular grain emulsions disclosed in the patents cited and incorporated by reference above. As taught by Kofron et al, cited above, iodide free high bromide tabular grain emulsions (e.g., silver bromide tabular grain emulsions) can be prepared merely with withholding iodide from the preparation of silver iodohalide high bromide tabular grain emulsions.

The host tabular grain emulsions contain at least 50 mole percent, preferably at least 70 mole percent and optimally at least 90 mole percent bromide, based on total silver. It is specifically contemplated to employ emulsions as starting materials that consist essentially of silver bromide. Minor amounts of other halides can be present. Silver bromide and silver chloride are compatible in all ratios in the face centered cubic crystal lattice structure that forms the grains. Thus, silver chloride can be present in the high bromide tabular grains and in the central regions of the tabular grains of the invention in concentrations of up to 50 mole percent, based on silver.

While any conventional iodide concentration can be present centrally within the grains of the host tabular grain emulsion, the surface iodide concentration is limited to less than 2 mole percent, based on silver within 0.02 μm of a grain surface. In the patents cited above to show conventional high bromide tabular grain emulsions, any of the high bromide tabular grain emulsions exhibiting iodide concentrations at or near the grain surfaces of 2 mole percent or more can be converted to low surface iodide tabular grain emulsions merely by shelling the tabular grains with a high bromide silver halide containing less than 2 mole percent iodide, based on silver forming the shell. It is recognized that it is generally most convenient to employ host tabular grain emulsions that exhibit low (<2 mole percent) iodide concentrations throughout the grains, including those that are entirely free of iodide.

The low surface iodide high bromide host tabular grains can have an average aspect ratio lower than that of the tabular grains in the emulsions produced by the process of the invention. Preferably the average aspect ratio of the host tabular grains is at least 5. The starting emulsion can have any convenient conventional higher average aspect ratio, such as any average aspect ratio reported in the patents cited above.

The average thickness of the low surface iodide high bromide host tabular grains can take any value compatible with achieving the desired final average aspect ratio of tabular grains produced. It is generally preferred that the thickness of the host tabular grains be less than 0.3 μm. Thin host tabular grains, those having an average thickness of less than 0.2 μm, are preferred. It is specifically contemplated to employ as starting materials ultrathin tabular grain emulsions—i.e., those having an average tabular grain thickness of <0.07 μm. Low surface iodide high bromide ultrathin tabular grain emulsions are included among the emulsion disclosures of the patents cited above to show conventional high bromide tabular grain emulsions and are additionally illustrated by the following, the disclosures of which are here incorporated by reference:

Zola and Bryant EPO 0 362 699;

Antoniades et al U.S. Pat. No. 5,250,403; and

Sutton et al U.S. Pat. No. 5,334,469.

Both the starting host tabular grain emulsions and the process product partially halide converted tabular grain emulsions produced are monodisperse. That is, the emulsions exhibit a coefficient of variation (COV) of grain ECD of less than 30 percent. Generally the advantages of monodispersity are enhanced as COV is decreased below 30 percent. Low surface iodide high bromide host tabular grain emulsions can be selected from among those known to the art exhibiting COV values of less than 15 percent and, in emulsions where particular care has been exercised to limit dispersity, less in 10 percent. Low COV high bromide tabular grain emulsions are included among the emulsion disclosures of the patents cited above to show conventional high bromide tabular grain emulsions and are additionally illustrated by the following, the disclosures of which are here incorporated by reference:

Saito et al U.S. Pat. No. 4,797,354;

Tsaur et al U.S. Pat. No. 5,210,013;

Kim et al U.S. Pat. No. 5,272,048; and

Sutton et al U.S. Pat. No. 5,334,469.

Low COV host tabular grains can be shelled according to the invention without increasing their dispersity.

The low surface iodide high bromide host tabular grain emulsions have tabular grain projected areas sufficient to allow the tabular grains in the final emulsion to account for at least 50 percent of total grain projected area. The preferred starting materials are those that contain tabular grain projected areas of at least 70 percent and optimally at least 90 percent. Generally, the exclusion of nontabular grains to the extent conveniently attainable is preferred.

Partial halide conversion of the host tabular grain emulsion can commence under any convenient conventional emulsion precipitation condition. For example, iodide introduction can commence immediately upon completing precipitation of the host tabular grain emulsion. When the host tabular grain emulsion has been previously prepared and is later introduced into the reaction vessel, conditions within the reaction vessel are adjusted within conventional tabular grain emulsion preparation parameters to those present at the conclusion of host tabular grain emulsion precipitation, taught by the host tabular grain emulsion citations above. For host tabular grain emulsions in which the tabular grains have {111} major faces the teachings of Kofron et al, cited above and here incorporated by reference, are generally applicable and preferred.

Partial halide conversion is achieved by reacting iodate with a reducing agent as described above to release iodide ion while withholding the addition of silver ion. The minimum amount of iodide ion released is chosen to achieve significant halide conversion. Preferably this amounts to at least 0.5 (most preferably 1.0) mole percent iodide ion, based on the silver contained in the host tabular grain emulsion. Maximum iodide ion incorporation is 10 mole percent, based on the silver contained in the host tabular grain emulsion. Limiting the amount of iodide ion released during the halide conversion step limits halide conversion and thereby contributes to maintaining the tabular grains intact.

Following the partial halide conversion step additional silver halide is precipitated, accounting for from 10 to 40 percent of the total silver forming the grains of the completed emulsion. The halide composition of the silver halide precipitation following halide conversion can take any conventional form so long as the completed grains retain a high bromide content. The silver halide precipitated following halide conversion is preferably selected from among the silver halide compositions used to form the host tabular grains. In one form it is specifically preferred to introduce only silver and bromide salts in forming the final 10 to 40 percent of the grains. Alternatively, it is contemplated to introduce additional iodide, but preferably the iodide is limited to less than 2 mole percent, based on the silver being concurrently precipitated.

Any convenient conventional technique for precipitating the last 10 to 40 percent of the total silver to complete formation of the high bromide tabular grains can be employed. For example, any conventional grain shelling technique can be employed. Typically grain shelling is accomplished by concurrently introducing silver and halide salts through separate jets. Alternatively, a silver halide Lippmann emulsion can be introduced to achieve shelling of the grains.

Instead of shelling the tabular grains with the final 10 to 40 percent of precipitated silver it is contemplated to conduct precipitation under conditions conducive to continued tabular grain growth—that is, under conditions that favor silver halide deposition along the peripheral edges of the tabular grains. Such techniques are illustrated by the patents cited above to show host tabular grain preparations.

In another specific preferred technique for precipitating the final 10 to 40 percent of silver forming the tabular grains, further precipitation can be achieved by introducing a soluble silver salt, such as silver nitrate, without adding halide. Since high bromide silver halide emulsions are conventionally precipitated and maintained in a stoichiometric excess of bromide ion to avoid fogging the grains, the addition of silver ions without concurrent halide addition results in a reaction between the silver ions and the stoichiometric excess bromide ions. These bromide ions can in part be those supplied by the bromide ion introduction during the partial halide conversion step. This technique for completing precipitation of the tabular grains is described in more detail in Fenton et al U.S. Pat. No. 5,476,760, cited above and here incorporated by reference, which demonstrates increased photographic sensitivity for the tabular grain emulsions so prepared.

The completed tabular grain emulsions preferably exhibit a mean ECD of less than 10 μm, preferably less than 5.0 μm. For most applications the tabular grains have a mean ECD of less than 3.0 μm. The tabular grains preferably exhibit an average aspect ratio of greater than 5 and, most preferably, greater than 8. Where the final 10 to 40 percent of silver is deposited under conditions that favor tabular grain growth, the mean thickness of the completed tabular grains can satisfy the thickness ranges set out above for the host tabular grains. In all instances (e.g., even when shelling is undertaken) the mean thickness of the completed tabular grains is preferably less than 0.3 μm.

Apart from the features that have been specifically discussed, the high bromide tabular grain emulsions can contain conventional features of the type disclosed in the patents cited above to illustrate high bromide host tabular grain emulsions. These conventional features include conventional selections of dopants, peptizers, vehicles and hardeners. Once prepared the emulsions can be chemically sensitized, spectrally sensitized, combined with antifoggants and stabilizers, image dye providing components, and other conventional photographic addenda. Such conventional features are illustrated by *Research Disclosure*, Vol. 389, September 1996, Item 38957.

EXAMPLES

The invention can be better appreciated by reference to the following specific embodiments. In each of the host tabular grain emulsions tabular grains accounted for substantially all (>97%) of total grain projected area.

Example 1

This example demonstrates the superior structural integrity of partially halide converted tabular grains produced by iodide ion release from iodate as opposed to directly introducing iodide ion during partial halide conversion.

Emulsion 1 (a comparative emulsion preparation)

This emulsion was prepared similarly as Emulsion 1E in Fenton et al U.S. Pat. No. 5,476,760.

In a 4-liter reaction vessel was placed an aqueous gelatin solution (composed of 1 liter of water, 0.56 g of alkali-processed low methionine gelatin, 3.5 ml of 4N nitric acid solution, 1.12 g of sodium bromide and having a pAg of 9.38 and 14.4 wt %, based on total silver used in nucleation, of PLURONIC-31R1™, a surfactant satisfying the formula:

$$HO-(\overset{CH_3}{\overset{|}{C}}HCH_2O)_y-(CH_2CH_2O)_x-(\overset{CH_3}{\overset{|}{C}}HCH_2O)_{y'}-H \quad (V)$$

where x=7, y=25 and y'=25) while keeping the temperature thereof at 45° C., 11.13 mL of an aqueous solution of silver nitrate (containing 0.48 g of silver nitrate) and 11.13 mL of an aqueous solution of sodium bromide (containing 0.29 g of sodium bromide) were simultaneously added thereto over a period of 1 minute at a constant rate. The mixture was held and stirred for 1 minute during which 14 mL of an aqueous sodium bromide solution (containing 1.44 g of sodium bromide) were added at the 50 second point of the hold. Thereafter, after the 1 minute hold, the temperature of the mixture was raised to 60° C. over a period of 9 minutes. Then 16.7 mL of an aqueous solution of ammonium sulfate (containing 1.68 g of ammonium sulfate) were added and the pH of the mixture was adjusted to 9.5 with aqueous sodium hydroxide (1N). The mixture thus prepared was stirred for 9 minutes. Then 83 mL of an aqueous gelatin solution (containing 16.7 g of alkali-processed gelatin) was added, and the mixture was stirred for 1 minute, followed by a pH adjustment to 5.85 using aqueous nitric acid (1N). The mixture was stirred for 1 minute. Afterward, 30 mL of aqueous silver nitrate (containing 1.27 g of silver nitrate) and 32 mL of aqueous sodium bromide (containing 0.66 g of sodium bromide) were added simultaneously over a 15 minute period. Then 49 mL of aqueous silver nitrate (containing 13.3 g of silver nitrate) and 48.2 mL of aqueous sodium bromide (containing 8.68 g of sodium bromide) were added simultaneously at linearly accelerated rates starting from respective rates of 0.67 mL/min and 0.72 mL/min for the subsequent 24.5 minutes. Then 468 mL of aqueous silver nitrate (containing 191 g of silver nitrate) and 464 mL of aqueous sodium bromide (containing 119.4 g of sodium bromide) were added simultaneously at linear accelerated rates starting from respective rates of 1.67 mL/min and 1.70 mL/min for the subsequent 82.4 minutes. A 1 minute hold while stirring followed.

Then 16.6 mL of an aqueous potassium iodide solution (containing 10.45 g of potassium iodide) were added over a three minute period at constant flow rate. The solution was delivered to a position in the kettle such that mixing was maximized. After a 10 minute hold, 220.8 mL of an aqueous silver nitrate solution (containing 90.1 g of silver nitrate) were added over a 26.5 minute period at constant flow rate. Then 6.5 minutes after the start of the silver nitrate addition 164.2 mL of aqueous sodium bromide (containing 42.2 g of sodium bromide) were added over a 20.0 minute period at a constant rate. The emulsion was then washed.

The silver halide emulsion thus obtained contained 3.6 mole percent iodide, based on total silver. The emulsion grains were characterized to be 2.31 μm in mean ECD and 0.12 μm in mean thickness.

Microscopic analysis of 211 grains indicated that 11 percent of the grains were either exploded grains (EG's) or only partially intact tabular grains (PIG's). This demonstrated the destructive effect of directly introducing iodide ion during partial halide conversion.

Emulsion 2 (an example emulsion preparation)

A silver bromide, monodisperse host tabular emulsion was prepared according to the procedure described in Tsaur et al U.S. Pat. No. 5,147,771. The host tabular grain emulsion was characterized to be 1.51 μm in mean ECD and 0.103 μm in mean thickness. This emulsion was washed and used as the host tabular grain emulsion for the following subsequent steps of the process.

Step 1: To ca. 5000 g of deionized water, 5.9 moles of the emulsion containing 40 g/mole of gelatin were added and mixed at 60° C., and the pAg was adjusted to ca. 9.87 and pH to ca. 6.

Step 2: Then 1 liter of a solution containing 126 g of sodium sulfite was added, followed by a five minute hold with stirring.

Step 3: Then 1 liter of a solution containing 65 g of potassium iodate was added, followed by a five minute hold with stirring.

Step 4: Then there was a 180 minute hold with stirring.

Step 5: Then the pAg of the emulsion was changed to 7.94 by adding 0.9 mole of a 2M silver nitrate solution at a constant ramp rate over a fifteen minute period, starting at 10 mL/min.

Step 6: After another five minute hold with stirring, when the pH was adjusted to ca. 6, 4.2 moles of silver bromide was precipitated over a period of 30 minutes, by adding 2M solutions of silver nitrate and sodium bromide through separate jets at a constant ramp rate, starting at 50 mL/min.

Step 7: The emulsion was then washed.

The grains of the emulsion were observed to exhibit a mean grain ECD of 1.83 μm and a mean thickness of 0.178 μm.

Microscopic analysis failed to locate EG or PIG grains. This demonstrated that the controlled release of iodide ion during partial halide conversion had eliminated structural degradation of the tabular grains. This is believed to be the result of avoiding excessive local iodide ion concentrations during partial halide conversion.

Example 2

This example compares the black-and-white (silver imaging) photographic performance of an emulsion prepared by the process of the invention with that of a similar emulsion prepared by controlled release of iodide ion during partial halide conversion, but employing a known iodide ion releasing organic compound in place of iodate.

Emulsion 3 (a comparative emulsion preparation)

This emulsion was prepared in the same manner as the Emulsion 1, satisfying the requirements of the invention, but with the following differences: The solution used in step 2 contained only water, while the solution used in step 3 contained 65 g of iodoacetic acid.

The grains of the emulsion were observed to exhibit a mean grain ECD of 1.8s μm and a mean thickness of 0.177 μm. Like Emulsion 2, microscopic observation failed to reveal either EG or PIG grains.

Sensitization

Emulsions 2 and 3 were sensitized (on a per Ag mole basis) with 2.0 mg potassium tetrachloroaurate, 85 mg sodium thiocyanate, 300 mg of the green spectral sensitizing dye anhydro-3,3'-bis(3-sulfopropyl)-5,5'-dichloro-9-ethyloxacarbocyanine hydroxide triethylammonium salt, 10 mg anhydro-5,6-dimethyl-3(3-sulfopropyl)benzothiazolium inner salt, 2.0 mg sodium thiosulfate pentahydrate, 0.21 mg potassium selenocyanate, heat ramped to 64° C. at 5° C./3 min, held for 5 minutes, and chilled down to 40° C. Subsequently, 225 mg potassium iodide and 1.2 g 5-methyl-s-triazole-(2-3-a)-pyrimidine-7-ol were added.

Coating

A 22.6 mg Ag/dm$^2$ sample of each emulsion along with 39.5 mg/dm$^2$ gelatin, and 2.35% by weight, based on the weight of gelatin of bis(vinylsulfonyl)methane hardener, were coated onto a clear poly(ethylene terephthalate) photographic film support.

Exposure and Processing

The coatings were exposed with green light through a 21-step tablet for 1/50 sec and then processed at 20° C. in a hydroquinone-Elon™ (N-methylaminophenol hemisulfate) developer for 5 minutes.

Sensitometry

Optical densities are expressed in terms of diffuse density as measured by an X-rite Model 310™ densitometer. The characteristic curve (density vs. log E, where E represents exposure in lux-seconds) was plotted for each coating processed. Speed, reported in relative log speed units (1 unit= 0.01 log E), was measured at 0.5 above minimum density. The granularities of the coatings were measured at approximately mid-scale points of equal density and reported in terms of gamma (γ) normalized rms granularity in grain units (GU). Normalizing γ eliminates apparent granularity differences. For a discussion of granularity measurement techniques see H. C. Schmitt and J. H. Altman, *Applied Optics*, 9, pp. 871–874, April 1970. Sensitometric results are summarized in Table II.

TABLE II

| Emulsion. | Dmin | Speed | G.U. | Rel. G.U. | Adjusted Speed |
|---|---|---|---|---|---|
| 2 (example) | 0.075 | 210 | 11.561 | −5 | 231 |
| 3 (comp.) | 0.078 | 182 | 14.795 | 0 | 182 |

From Table II it is apparent that the emulsion produced by the process of the invention exhibited both higher speed and lower granularity than the Emulsion 3 produced by a comparative process. To allow the relative speeds of the emulsions to be compared at equal levels of granularity, speed was adjusted using the art-recognized relationship that 30 relative log speed units are equivalent to 7 grain units. With this adjustment, the emulsion produced by the process of the invention exhibited a speed advantage of 49 relative log speed units (i.e., 0.49 log E).

Example 3

This example compares the performance of Emulsion 2, an example of the preparation process of the invention, and comparative Emulsion 3 in color (dye image-forming) photographic system.

Emulsions 2 and 3 were identically sensitized (on a per Ag mole basis) with 90 mg of potassium thiocyanate, 430 mg of anhydro-5-chloro-9-ethyl-5'-phenyl-3'-(3-sulfobutyl)-3-(3-sulfopropyl)-oxacarbocyanine hydroxide, sodium salt, 72 mg anhydro-3,9-diethyl-3'-diethyl-3'-methylsulfonylcabamoylmethyl-5-phenyloxathiocarbocyanine hydroxide inner salt, 1 mg of the gold (I) sensitizer AU-1

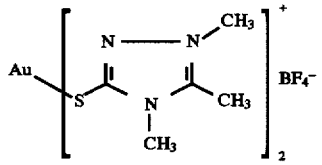

(AU-1)

and 30 mg of the antifoggant 3-[(2-methylsulfonamidocarbonyl)ethyl]benzothiazolium tetrafluoroborate. The emulsion sample was heated to 65° C. and held at that temperature for 20 minutes. Subsequently, the antifoggant 4-hydroxy-6-methyl-1,3,3A,7-tetraazaindene was added.

The sensitized emulsion samples were combined with the cyan dye-forming coupler C-1.

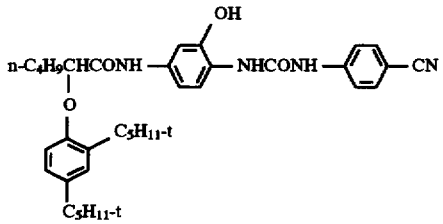

(C-1)

The die-forming coupler containing samples were coated on a photographic film support with a silver coverage of 807 mg/m$^2$ and a coupler laydown twice that of the silver coverage.

A sample of each coating was exposed with a tungsten light source for 1/50th second through a Wratten™ 9 filter. Exposed film samples were developed for 3 minutes and 15 seconds using Kodak Flexicolor™ C-41 color negative processing. Speed was measured as in the previous Example, except that it was referenced to a density of 0.15.

Sensitometric results are summarized indicated in Table III.

TABLE III

| Emulsion | Dmin | Speed |
|---|---|---|
| 2 (example) | 0.11 | 430 |
| 3 (comparative) | 0.04 | 100 |

From Table III it is apparent that a very large speed advantage (3.3 log E) was enjoyed by the emulsion prepared by the process of the invention.

Attempts to increase the speed of Emulsion 3 prepared by the comparative process by increasing the level of gold sensitizer by a factor of 4 were not successful in significantly reducing the speed deficit. When a conventional sulfur sensitizer was employed in Emulsion 3 in combination with the gold sensitizer, the speed of Emulsion 3 increased to approximate parity with the gold only sensitized sample of Emulsion 2. From this it was concluded that the sulfite ion employed as a reducing agent in combination with the iodate was performing a useful and unexpected secondary function in acting as a sulfur sensitizing agent.

Example 4

This example demonstrates that different levels of sensitivity are obtained in effecting partial halide conversion of low surface iodide high bromide tabular grain emulsions, depending upon the grain dispersity of the emulsions.

Emulsion 4 (a monodisperse host emulsion)

A silver bromide, monodisperse host tabular emulsion was prepared according to the procedure described in Tsaur et al U.S. Pat. No. 5,147,771. The host tabular grain emulsion was characterized to be 1.43 μm in mean ECD and 0.109 μm in mean thickness. The COV of the grain ECD was 9 percent.

This emulsion was washed and used as the host tabular grain emulsion for the following subsequent steps of the process.

Step 1: To ca. 1500 g of deionized water, 1.14 moles of the emulsion containing 40 g/mole of gelatin were added and mixed at 60° C., and the pAg was adjusted to ca. 9.87 and pH to ca. 5.5.

Step 2: Then 0.5 liter of a solution containing 25 g of potassium iodate was added, followed by a five minute hold with stirring.

Step 3: Then 0.5 liter of a solution containing 65 g of sodium sulfite was added, followed by a five minute hold with stirring.

Step 4: Then there was a 180 minute hold with stirring.

Step 5: Then the emulsion was washed.

The grains of the emulsion were observed to exhibit a mean grain ECD of 1.45 μm and a mean thickness of 0.114 μm.

Emulsion 5 (a polydisperse host emulsion)

A polydisperse silver iodobromide host tabular grain emulsion was prepared by first charging a reaction vessel with 0.667 g/L of gelatin, 0.953 g/L NaBr, 0.1 g/L of the surfactant Emerest™ (polyethylene glycol oleate) and 6 L of distilled water. The contents of the reaction vessel were adjusted to a pH of 3.5 and a pBr of 1.9621 at a temperature of 70° C. Nucleation occurred during a 10 second period during which 1.80 m/L of $AgNO_3$ and an equal volume of 1.8 m/L of mixed salts (1.782 m/L of NaBr and 0.018 m/L of KI) were added at a rate of 80.0 mL/min. A 6 minute hold time ensued, followed by a 7 minute transition to 80° C. Additional gelatin, 30 g, and 0.55 g of the above surfactant along with 1.5 L of distilled water were then introduced. The temperature was raised to 80° C., and the pH of the vessel was adjusted to 4.5.

A first growth segment (I) then occurred over a period of 4.5 minutes at a pBr of 1.7798, by double jetting a 2.5M silver nitrate solution at a rate of 15 mL/min versus a sodium bromide solution of the same concentration at 17.8 mL/min. A second growth segment (II) took place over 15 minutes by continuing precipitation as described for growth segment I, except that the silver nitrate was ramped linearly to 26.0 mL/min and the salt to 27.2 mL/min. A third growth segment (III) was undertaken for 15 minutes in which the respective flow rates were extended to 39 and 40.2 mL/min. A fourth growth segment (IV), ensued for 13.5 minutes in which the flow rates were extended to 63 and 64.9 mL/min respectively. A fifth growth segment (V) lasting 13.5 min extended these flow rates to 92.6 and 95.1 mL/min respectively. A final 18 minute growth segment (VI) extended these flow rates to 115.0 and 117.9 mL/min, respectively.

The emulsion was then cooled to 40° C., washed, and adjusted to a pBr of 3.378. The pH of the emulsion was adjusted to 5.6.

The host tabular grain emulsion was characterized to be 1.80 μm in mean ECD and 0.098 μm in mean thickness. The COV of the grain ECD was 39 percent.

The host tabular grain emulsion was then subjected to partial halide conversion similarly as described above for Emulsion 4, starting with Step (2).

The final tabular grain emulsion was characterized to be 2.02 μm in mean ECD and 0.099 μm in mean thickness.

Transmission Electron Microscopy

Examination of samples of Emulsions 4 and 5 by transmission electron microscopy revealed similar edge structures, but polydisperse Emulsion 5 additionally exhibited a network of dislocations on the {111} major faces of the tabular grains that were less prominent in the monodisperse Emulsion 4.

Sensitometric Evaluation

A one mole sample of each of Emulsions 4 and 5 was melted at 40° C. Then, in sequence, the following reagents were added with 5 minute holds between each successive addition: 1.111 mmoles of NaSCN, 800 mg (1.123 mmole) of the spectral sensitizing dye anhydro-3,3'-bis(3-sulfopropyl)-5-chloronaphtho[1,2-d]thiazolothiacyanine hydroxide triethylammonium salt, 0.02724 mmole of 1,3-dicarboxymethyl-1,3-dimethylthiourea, 0.0053 mmole of the gold sensitizer AU-1, and 2.5 mg of 3-methyl-1,3-benzothiazolium iodide. Chemical sensitization was effected by raising the emulsion melt containing addenda to 57° C. and holding for 7 minutes. Subsequently, the melt was cooled to 40° C. and was then prepared for coating.

Single emulsion layer coatings were formulated containing 10.76 mg/dm$^2$ of silver, three times that amount of gelatin, and 9.684 mg/dm$^2$ of the yellow dye-forming coupler Y-1.

(Y-1)

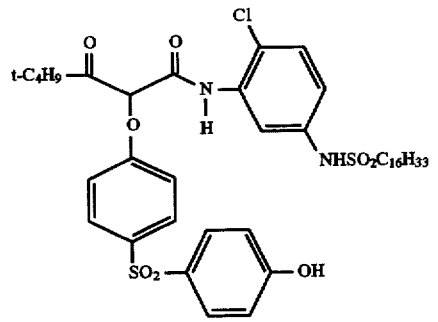

The dye-forming coupler containing emulsion layer was overcoated with 8.608 gm/dm$^2$ of gelatin and hardened with 1.5 percent by weight of bis(vinylsulfonyl)-methane hardener.

Coatings were exposed through a 0–4 density step tablet for 1/50" using a Wratten™ 2B filter with a 0.6 density inconel filter and a 3000° K color temperature (tungsten balance) light source. A standard 3.25 min development in an Eastman ECN™ color negative process was used to develop the latent image.

The results are summarized in Table IV.

TABLE IV

| Emulsion | Dmin | Maximum Gamma | Inertial Speed |
|---|---|---|---|
| 5 (polydisperse host tabular grains) | 1.06 | 0.16 | 145 |
| 4 (monodisperse host tabular grains) | 0.17 | 2.34 | 242 |

Speed is reported as relative log speed—i.e., 0.01 log E=1 relative log speed unit. Speed was measured from the characteristic curves at the exposure level lying at the intersection of the linear extrapolations of average contrast and minimum density.

From Table IV it is apparent that the partial halide conversion of the polydisperse tabular grain emulsion produced elevated minimum density, lower contrast (gamma), and lower speed than the same partial halide conversion steps produced on a monodisperse host tabular grain emulsion.

When 365 nm line exposure was substituted for the visible light exposure, essentially similar differences in speed were observed, indicating the increased speed of the partially halide converted monodisperse tabular grain emulsion was a function of the grain structure rather than the spectral sensitization of the grains.

The invention has been described in detail with particular reference to preferred embodiments thereof, but it will be understood that variations and modifications can be effected within the spirit and scope of the invention.

What is claimed is:

1. A process for preparing a photographically useful emulsion comprised of a dispersing medium and radiation-sensitive silver iodohalide grains comprised of the following steps:

(1) providing an aqueous dispersing medium including a peptizer for the silver iodohalide grains, (2) precipitating silver halide grains having a face centered cubic rock salt crystal lattice structure, and (3) introducing into the crystal lattice structure iodide ions released from $IO_3^-$.

2. A process according to claim 1 wherein the iodide ions are released by reacting the $IO_3^-$ with a reducing agent.

3. A process according to claim 2 wherein the reducing agent and the $IO_3^-$ are introduced into the aqueous dispersing medium during or following step (2).

4. A process according to claim 2 wherein the reducing agent is present in a molar amount at least equal to the molar amount of the $IO_3^-$.

5. A process of preparing a high bromide tabular grain emulsion comprised of tabular grains containing within a portion thereof iodide ions introduced by displacement of halide ions comprising (1) providing a monodisperse high bromide host tabular grain emulsion accounting for from 60 to 90 percent of total silver present at the completion of step (3), (2) introducing iodide ion in an aqueous solution into the host tabular grain emulsion while withholding addition of silver ion, the iodide ion amounting to from 0.5 to 10 mole percent, based on silver present in the host emulsion, and (3) thereafter continuing growth of the host tabular grains modified by iodide ion introduction until silver added in this step accounts for from 10 to 40 of total silver, wherein (4) in step (1) grains present in the host tabular grain emulsion exhibit a surface iodide concentration of less than 2 mole percent, based on silver within 0.02 μm of the surface of the grains, and (5) during step (2) the iodide ion is released from $IO_3^-$.

6. A process according to claim 5 wherein the host tabular grain emulsion contains less than 2 mole percent iodide, based on silver.

7. A process according to claim 6 wherein the host tabular grain emulsion is a silver bromide emulsion.

8. A process according to claim 5 wherein the iodide ion released from $IO_3^-$ accounts for at least 1.0 mole percent of the silver present in the host emulsion.

9. A process according to claim 5 wherein the iodide ions are released by reacting the $IO_3^-$ with a reducing agent having an oxidation potential more negative than +0.620 volt and more positive than +0.095 volt.

10. A process according to claim 9 wherein the reducing agent is a silver halide developing agent.

11. A process according to claim 9 wherein the reducing agent is ascorbic acid.

12. A process according to claim 9 wherein the reducing agent is a water soluble sulfite.

13. A process according to claim 12 wherein the sulfite is present in a molar ratio of to $IO_3^-$ of from 1:1 to 10:1.

14. A process according to claim 13 wherein the sulfite is present in a molar ratio of to $IO_3^-$ of from greater than 1:1 to 5:1.

* * * * *